US008653763B2

(12) United States Patent
Lin et al.

(10) Patent No.: US 8,653,763 B2
(45) Date of Patent: Feb. 18, 2014

(54) VENTILATOR AND ITS IMPELLER

(75) Inventors: Chih-Hua Lin, Taoyuan Hsien (TW); Yan-Lin Chen, Taoyuan Hsien (TW); Te-Chung Liu, Taoyuan Hsien (TW); Shih-Tzung Hsu, Taoyuan Hsien (TW); Pei-Chang Kuo, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 610 days.

(21) Appl. No.: 12/434,988

(22) Filed: May 4, 2009

(65) Prior Publication Data

US 2010/0068987 A1 Mar. 18, 2010

Related U.S. Application Data

(63) Continuation-in-part of application No. 12/210,149, filed on Sep. 12, 2008, now abandoned.

(30) Foreign Application Priority Data

Jan. 8, 2009 (TW) ..... 98100434 A
Jan. 8, 2009 (TW) ..... 98100435 A

(51) Int. Cl.
*H02P 1/54* (2006.01)
*H02P 1/46* (2006.01)
*H02P 1/50* (2006.01)

(52) U.S. Cl.
USPC ..... 318/101; 318/722; 454/15; 454/188; 454/354

(58) Field of Classification Search
USPC ..... 318/101, 722; 454/15, 188, 354
See application file for complete search history.

(56) References Cited

U.S. PATENT DOCUMENTS

| | | | | |
|---|---|---|---|---|
| 6,488,475 | B2 * | 12/2002 | Murata et al. | 417/32 |
| 7,515,444 | B2 * | 4/2009 | Chen | 363/97 |
| 2003/0067243 | A1 * | 4/2003 | Hollenbeck et al. | 310/254 |
| 2005/0254959 | A1 | 11/2005 | Furuta | |
| 2006/0002081 | A1 * | 1/2006 | Hongo et al. | 361/691 |
| 2007/0253806 | A1 * | 11/2007 | Russell | 415/15 |
| 2009/0214337 | A1 * | 8/2009 | Yoshida et al. | 415/214.1 |

FOREIGN PATENT DOCUMENTS

| | | | |
|---|---|---|---|
| CN | 2711421 | Y | 7/2005 |
| CN | 101004177 | A | 7/2007 |
| DE | 102 04 037 | A1 | 8/2003 |
| EP | 1 541 933 | A2 | 6/2005 |
| JP | 2007-247919 | | 9/2007 |
| TW | 158862 | | 5/1991 |
| TW | 200723649 | | 6/2007 |
| TW | D125655 | | 10/2008 |
| WO | WO-2005/073563 | A1 | 8/2005 |

* cited by examiner

*Primary Examiner* — Erick Glass
(74) *Attorney, Agent, or Firm* — Muncy, Geissler, Olds & Lowe, PLLC

(57) ABSTRACT

A ventilator includes a base, a drive device disposed on the base, an impeller coupled to the drive device and driven by the drive device, and a cover assembled with the base to define a closed area between the cover and the base for receiving a first circuit board therein, wherein when an AC power source is input to the first circuit board to be converted, a DC power source is output to drive the drive device.

17 Claims, 10 Drawing Sheets

VENTILATOR AND ITS IMPELLER

CROSS REFERENCE TO RELATED APPLICATIONS

The present invention is a continuation-in-part application of the parent application bearing Ser. No. 12/210,149 and filed on Sep. 12, 2008 now abandoned. This Non-provisional application also claims priority under 35 U.S.C. §119(a) on Patent Application No(s). 098100434 and 098100435, both of which are filed in Taiwan, Republic of China on Jan. 8, 2009, the entire contents of which are hereby incorporated by reference.

BACKGROUND OF THE INVENTION

1. Field of Invention

The present invention relates to a fan and in particular to a bathroom ventilator with a soft-start, low noise, power-saving and waterproof functions.

2. Related Art

The bathroom is usually equipped with the bathroom ventilator. When the user turns on the switch, the bathroom ventilator starts to generate airflows in the bathroom and thus carry the bad smell or moisture out.

However, the conventional bathroom ventilator does not have the soft-start function. Thus, once the bathroom ventilator is switched on, it will rotate at full speed within a very short time. In this case, the user can obviously hear the noise caused by the bathroom ventilator. If the noise raising rate of the bathroom ventilator reaches about 10 dB per second, the noise will make the user feel uncomfortable.

In addition, to switch on the bathroom ventilator from still state to full speed state requires a very large start-up current. Thus, the inrush current, voltage spike or spike noise may occur in the starting moment when switching on the bathroom ventilator. Moreover, the arc (electric arc phenomenon) may be generated to damage the bathroom ventilator.

Please refer to FIG. 7 which shows the conventional bathroom ventilator. The conventional bathroom ventilator is composed of a grille 10, a frame 11, an impeller 12, an AC motor 14 and a housing 15. The impeller 12 is driven by the AC motor 14. Because the conventional bathroom ventilator does not have any waterproof mechanism, the motor and its coil will be directly contaminated by dust or water to cause the dangerous voltage so that the product reliability and safety will be greatly reduced. Furthermore, the electric power for driving the conventional bathroom ventilator is usually provided by the utility power system. However, the utility power system provides the AC power supply so that the ventilator using AC motor powered by the AC power supply usually consumes relatively more energy, which leads to larger power consumption.

In addition, the impeller 12 has a base plate 12*a*, a hub 12*b* disposed on the base plate 12*a*, several blades 12*c* disposed on the base plate 12*a*, and a ring 12*d* connecting the top portions of the blades 12*c*. However, due to the small number of blades, the performance of air intake will be affected and the noise of airflow is loud. The noise mainly comes from the electrical noise of motor, vibration and airflow, wherein the noise of airflow is the major source.

SUMMARY OF THE INVENTION

In view of the foregoing, the present invention is to provide a ventilator with the soft-start function that can reduce the noise and prevent the inrush current, voltage spike or spike noise, thereby increasing the product reliability, extending the life time of the product and reducing the power consumption. The ventilator also has low-noise, power-saving and waterproof functions.

To achieve the above object, the present invention discloses a ventilator including a base, a drive device disposed on the base, an impeller coupled to the drive device and driven by the drive device, and a cover assembled with the base to define a closed area between the cover and the base for receiving a first circuit board therein, wherein when an AC power source is input to the first circuit board to be converted, a DC power source is output to drive the drive device.

The ventilator further includes a housing for receiving the impeller therein, wherein the base is disposed in the housing, and risen toward an inside of the housing to form an accommodation space.

In addition, the ventilator further includes a duct connector assembled with the housing, and a baffle disposed in the duct connector, wherein the baffle is opened by the airflow generated from the impeller when the impeller is driven and rotated by the drive device, and the baffle is closed by gravity when the impeller stops to rotate.

Further, the ventilator further includes an axial tube having an end passing through the base and into the accommodation space, wherein at least one bearing is disposed in the axial tube, and a second circuit board telescoped onto the end of the axial tube and disposed in the accommodation space.

Preferably, the second circuit board is a DC drive circuit board and the first circuit board includes an AC/DC converter. The AC/DC converter includes two diodes to prevent a reverse current, a voltage-drop module for outputting the DC power source to the drive device, and a rectification module coupled to the voltage-drop module for receiving the AC power source.

The rectification module includes an AC filter and a bridge rectification circuit, the AC filter receives the AC power source and filters a low-band frequency portion of the AC power source away, and the bridge rectification circuit is coupled to the AC filter and the voltage-drop module for converting the AC power source into the DC power source to be transmitted to the voltage-drop module.

The voltage-drop module includes a transformer coupled to the rectification module for decreasing the DC power source to a work voltage, a switch electrically connected to the transformer for outputting the stabilized work voltage, a coupler coupled to the transformer for retrieving a feedback signal from the transformer and outputting a coupling signal, a controller electrically connected to the switch and the coupler for outputting a control signal to the switch according to the coupling signal, and a DC filter coupled to the transformer and the control device for receiving the stabilized work voltage and filtering a high-band frequency portion of the stabilized work voltage.

The first circuit board further includes a control module electrically connected to the AC/DC converter and the drive device, wherein the control module comprises a converter, a Hall element and a micro control unit (MCU), the converter is coupled to the DC filter for decreasing the work voltage, the decreased work voltage is used as a power source for the Hall element and the MCU. The MCU is coupled to the drive device for generating a soft-start signal to drive and control a rotation speed of the drive device. The Hall element is coupled to the MCU for sensing a variation of a magnetic field of the drive device so as to output a feedback signal to the MCU, and the MCU controls the drive device according to the feedback signal.

Preferably, the first and second circuit boards are integrated in the same circuit board and disposed in the closed area formed between the base and the cover.

The impeller comprises a hub, a base plate coupled to the hub, a first blade set disposed around the hub and on the base plate, and a first annular part disposed at an outer lateral edge of each blade of the first blade set.

Preferably, the impeller further includes a second blade set disposed around the hub, the first and second blade sets are coupled with each other by a second annular part, and the first blade set has a plurality of blades arranged with those of the second blade set in an alternate or symmetrical manner. The base plate is coupled to the hub through an inclined part with an oblique or curved plane.

Preferably, a ratio of a height of the hub to that of the impeller is ranged between 0.3 and 0.55.

Preferably, a ratio of a height of the impeller to a diameter of the impeller is ranged between 0.8 and 0.9.

Preferably, a blade number of the impeller is greater than 60.

To achieve the above object, the present invention discloses a ventilator including a housing, a base disposed in the housing, and an impeller mounted on the base and comprising a hub, wherein a ratio of a height of the hub to that of the impeller is ranged between 0.3 and 0.55.

To achieve the above object, the present invention discloses a ventilator including a housing, a base disposed in the housing, and an impeller mounted on the base, wherein a ratio of a height of the impeller to a diameter of the impeller is ranged between 0.8 and 0.9.

As mentioned above, the ventilator of the present invention drives and controls the rotation speed of the motor according to the soft-start signal so that the rotation speed of the bathroom ventilator can be increased slowly to the target rotation speed. Compared with the prior art, the present invention can reduce the noise and prevent the inrush current, voltage spike or spike noise, thereby increasing the product reliability and extending the life time of the product.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
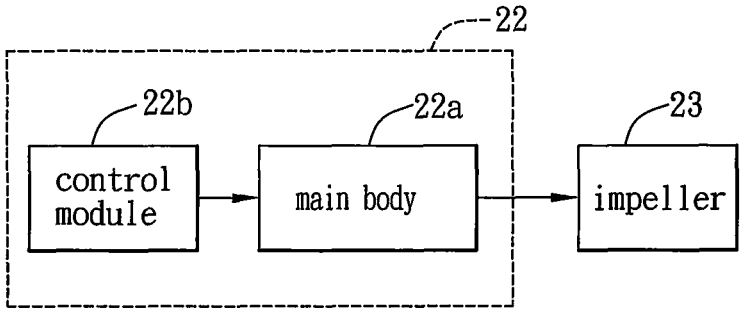
FIG. 1 is a block diagram showing a ventilator with the soft-starting function according to the present invention.

With reference to FIG. 1, a ventilator with the soft-starting function according to an embodiment of the present invention includes an impeller 23 and a motor 22. The motor 22 is coupled to the impeller 23 for driving the impeller 23 to rotate. The motor 22 includes a main body 22*a* and a controlling module 22*b* coupled to the motor body 22*a*. The types of the impeller 23 and motor 22 are not limited to the present embodiment. The impeller 23 includes a hub and a plurality of blades, and the blades are disposed around the hub. The main body 22*a* of the motor 22 includes a stator and a rotor, and the motor 22 drives the impeller 23 to rotate.

Figure 2A:
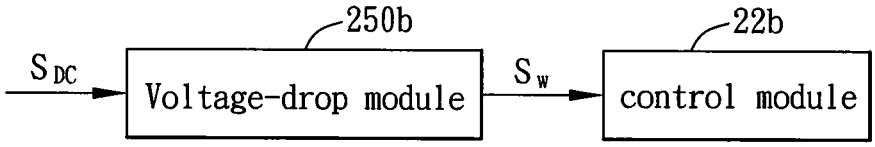
FIGS. 2A and 2B are block diagrams showing the ventilator powered by the DC power source and the AC power source.
Figure 2B:
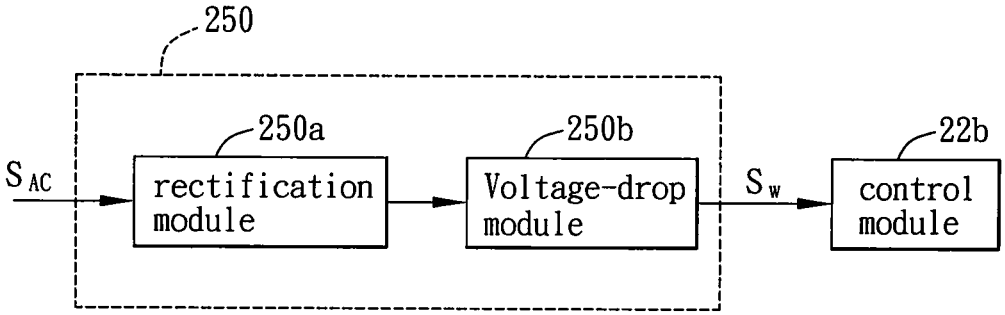

Referring to FIGS. 2A and 2B, a power source, such as a DC power source $S_{DC}$ or an AC power source $S_{AC}$, is provided to apply power to the motor 22. As shown in FIG. 2A, when the power source is a DC power source $S_{DC}$, a voltage-drop module 250*b* is needed to decrease the DC power source $S_{DC}$ to the work voltage $S_W$ of the motor 22. As shown in FIG. 2B, when the power source is an AC power source $S_{AC}$, an AC/DC converter 250 is needed to convert the AC power source $S_{AC}$ into a DC power source. The AC/DC converter 250 includes a voltage-drop module 250*b* and a rectification module 250*a* coupled to the voltage-drop module 250*b*. The rectification module 250*a* can convert the input AC power source $S_{AC}$ to the DC power source $S_{DC}$. Then, the voltage-drop module 250*b* decreases the DC power source $S_{DC}$ to the work voltage $S_W$ of the motor 22 so as to provide the required electric power for switching on the ventilator.

Figure 3:
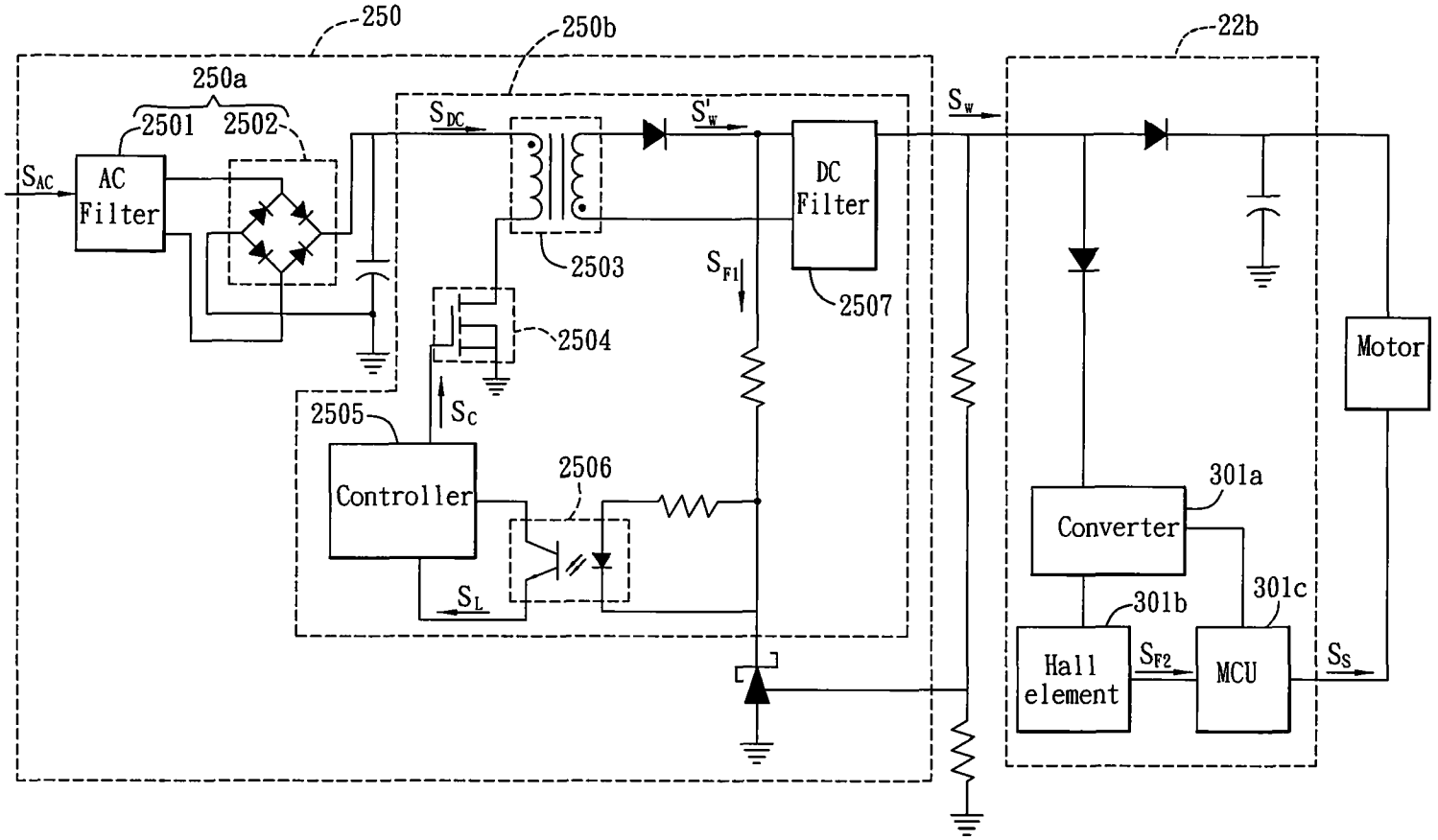
FIG. 3 is a circuit diagram of the first circuit board of the ventilator according to the present invention.

After the ventilator is switched on, the control module 22*b* generates a soft-start signal $S_S$ for driving and controlling the rotation speed of the motor as shown in FIG. 3. Alternatively, the soft-start signal $S_S$ can be generated by an external device such as a soft-start circuit, and then the soft-start signal $S_S$ is transmitted to the control module 22*b*.

To make the present invention more comprehensive, the implemental circuits of the AC/DC converter 250 and the control module 22*b* will be described herein below. With reference to FIGS. 2B and 3, the AC/DC converter 250 includes a rectification module 250*a* including an AC filter 2501 and a bridge rectification circuit 2502. The AC filter 2501 receives the AC power source $S_{AC}$ and filters the low-band frequency portion of the AC power source $S_{AC}$ away. The bridge rectification circuit 2502, which is coupled to the AC filter 2501 and the voltage-drop module 250*b*, converts the AC power source $S_{AC}$ into the DC power source $S_{DC}$. Then, the DC power source $S_{DC}$ is transmitted to the voltage-drop module 250*b*.

The voltage-drop module 250*b* includes a transformer 2503, a coupler 2506, a controller 2505, a switch 2504 and a DC filter 2507. The transformer 2503 is coupled to the rectification module 250*a* and decreases the DC power source $S_{DC}$ to the work voltage $S'_W$ of the motor. The coupler 2506, which is coupled to the transformer 2503 and the controller 2505, retrieves a feedback signal $S_{F1}$ from the transformer 2503 and outputs a coupling signal $S_L$ to the controller 2505. The controller 2505, which is coupled to the coupler 2506 and the switch 2504, outputs a control signal $S_C$ to the switch 2504 according to the coupling signal $S_L$. The ON/OFF of the switch 2504 can control the transformer 2503 to output the stabilized work voltage $S'_W$. The DC filter 2507 is coupled to the transformer 2503, the motor and the control module 22*b* for receiving the work voltage $S'_W$. Then, the DC filter 2507 filters the high-band frequency portion of the work voltage $S'_W$ and outputs the work voltage $S_W$, which is the electrical energy for switching on the motor and the control module 22*b*.

The control module 22*b* includes a converter 301*a*, a Hall element 301*b* and a micro control unit (MCU) 301*c*. The converter 301*a* is coupled to the DC filter 2507 for decreasing the work voltage $S_W$. Then, the decreased work voltage $S_W$ can be the power source for the Hall element 301*b* and the MCU 301*c*. The MCU 301*c* is coupled to the motor and generates a soft-start signal $S_S$ for driving and controlling the rotation speed of the motor. When the motor is started, the magnetic field will change depending on the rotation speed. The Hall element 301*b* is coupled to the MCU 301*c* and senses the variation of the magnetic field so as to output a feedback signal $S_{F2}$ to the MCU 301*c*. Then, the MCU 301*c* controls the motor according to the feedback signal $S_{F2}$. The MCU 301*c* outputs a signal $S_S$ to control the motor corresponding to the feedback signal $S_{F2}$. In addition, the implemental circuit of the AC/DC converter 250 shown in FIG. 3 further shows two diodes for preventing the reverse current.

Figure 4A:
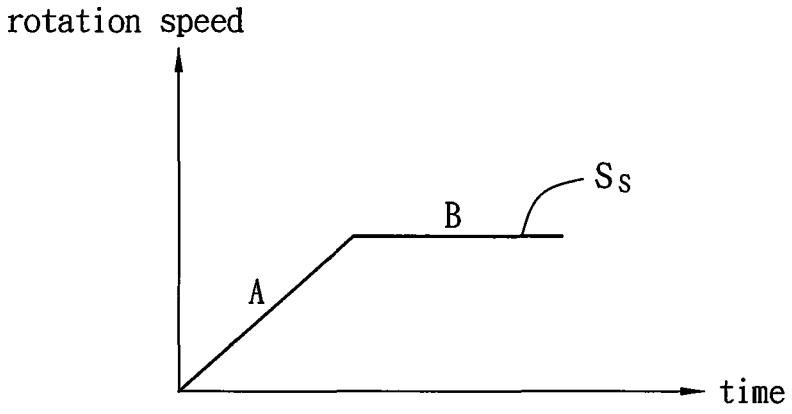
FIGS. 4A and 4B are schematic diagrams showing the soft-start signal of the ventilator of the present invention.

FIG. 4A shows a soft-start signal $S_S$ of the present invention. The soft-start signal $S_S$ includes a soft-start section A and a target-driving section B. The control module 22*b* slowly increases the rotation speed of the motor from the soft-start section A to reach the target-driving section B. The control module 22*b* can also adjust a slope of the soft-start section A. Accordingly, the rate (or time) for the motor to reach the target-driving second B can be controlled so as to decrease the noise.

The soft-start section A can be connected to the target-driving section B smoothly. Thus, the rotation speed of the motor can be increased slowly so that the inrush current, voltage spike or spike noise caused by the rapidly increased rotation speed can be prevented. The soft-start section A can be a linear curve or a second-degree curve. Therefore, when the ventilator is switched on, the rotation speed of the motor can be increased slowly from zero to the target rotation speed (such as a full speed). In the present invention, the noise raising rate of the ventilator during the soft-start section A is not larger than 2 dB per second.

Figure 4B:
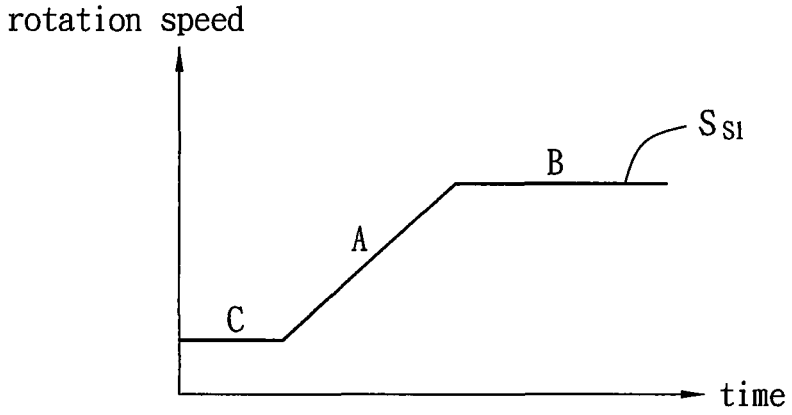

FIG. 4B shows another soft-start signal $S_{S1}$ of the present invention. The soft-start signal $S_{S1}$ includes a soft-start section A, a target-driving section B and an initial rotation-speed section C. The control module 22*b* keeps the rotation speed of the motor at an initial rotation speed according to the rotation speed of the initial rotation-speed section C before the rotation speed of the motor is increased. Then, the control module 22*b* slowly increases the rotation speed of the motor from the soft-start section A to reach the target-driving section B. In this case, the rotation speed can be increased stably and slowly so that the noise can also be decreased.

Alternatively, the ventilator with the soft-start function according to the present invention can be a DC fan. An AC/DC converter 250 is configured to convert the AC power source (utility power) into the DC power source. Then, the DC power source is transmitted to the DC fan for driving the DC fan to rotate. Compared with the AC fan, the DC fan has the advantage of lower power consumption.

Moreover, the ventilator with the soft-start function according to the present invention can be an electrically commutated fan (EC fan), which has an AC/DC converter for converting the AC power source (utility power) into the DC power source. Then, the DC power source drives the EC fan to rotate. In practice, the additional AC/DC converter is not needed for the EC fan so the circuit design can be simplified.

Figure 5A:
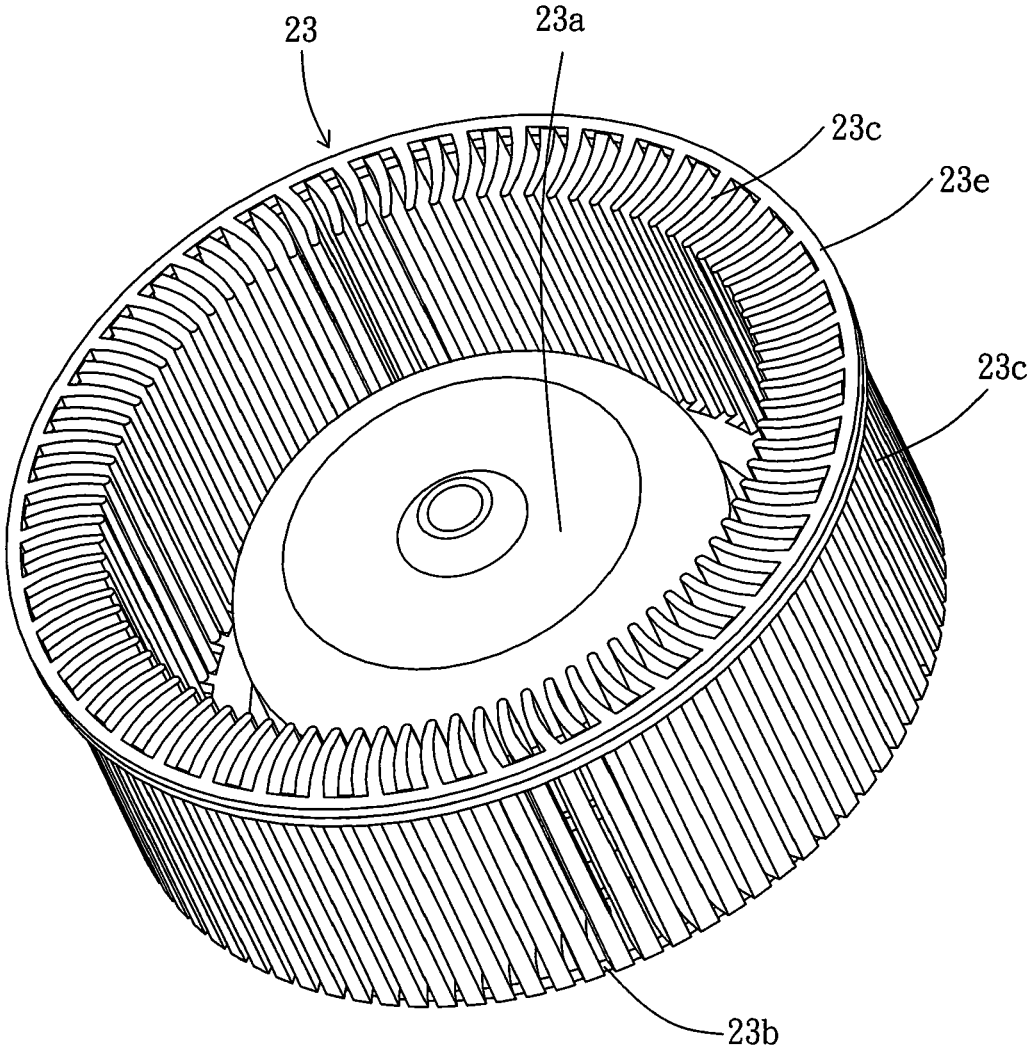
FIGS. 5A and 5B are perspective diagrams respectively showing different types of the impellers of the present invention.
Figure 5B:
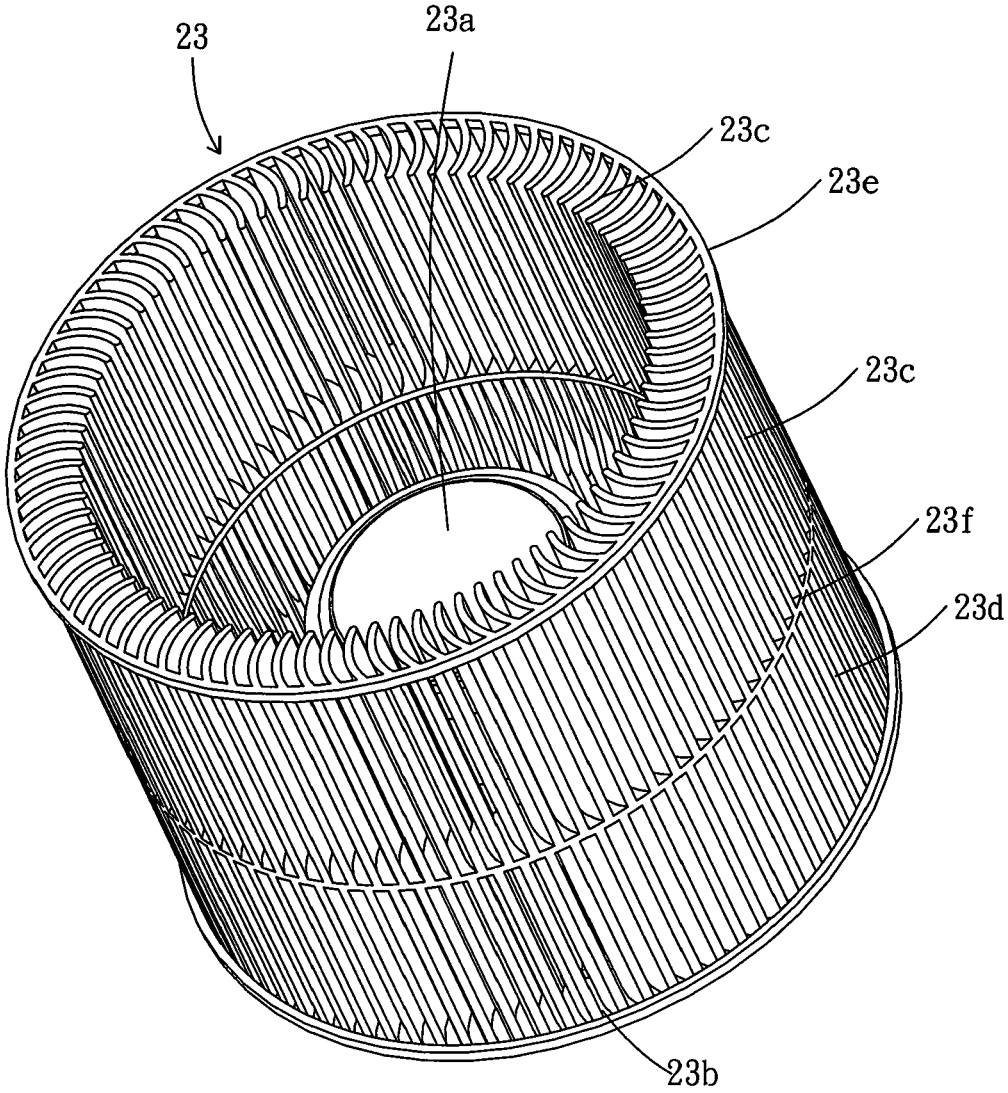
Figure 6A:
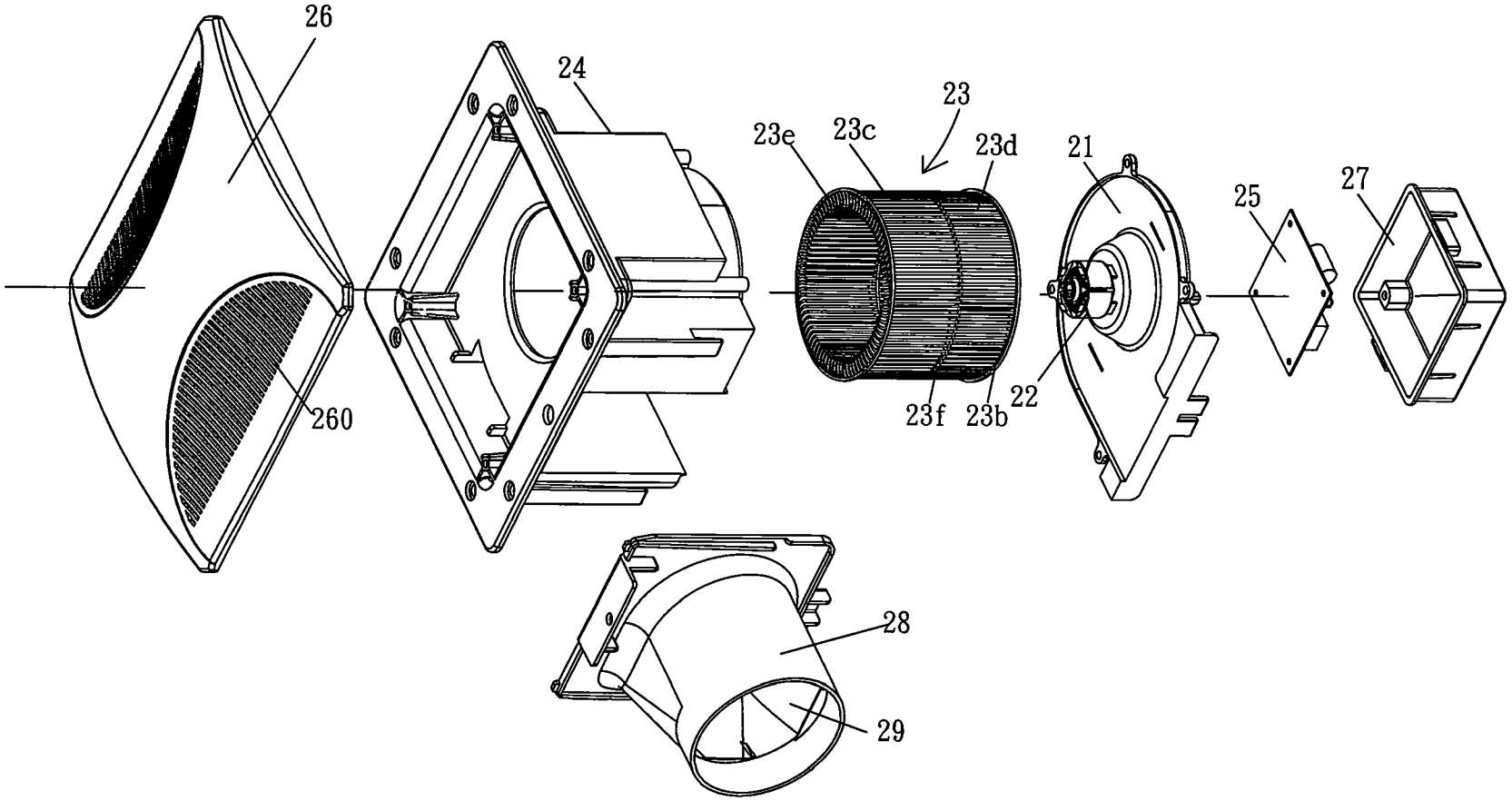
FIG. 6A is an exploded view of the ventilator according to the present invention.
Figure 6B:
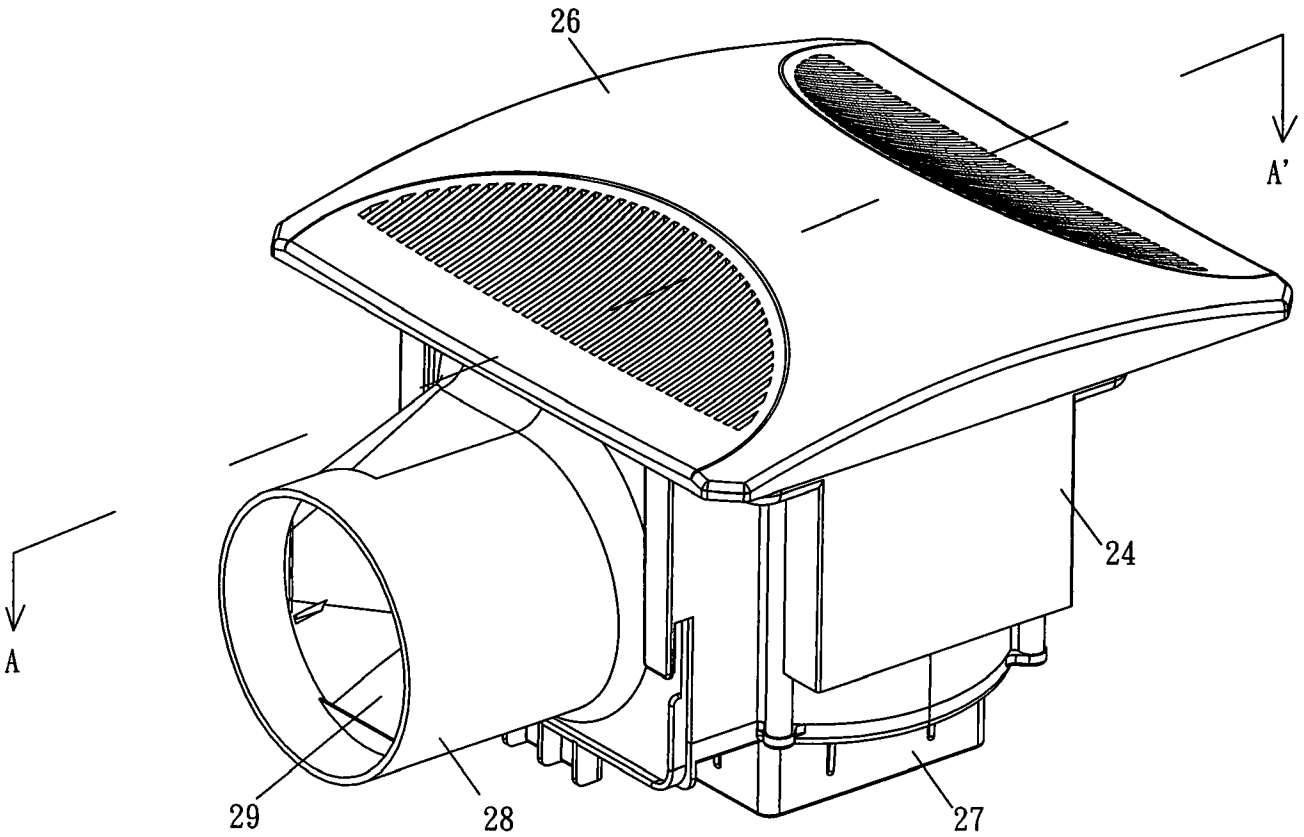
FIG. 6B is a perspective view of the ventilator shown in FIG. 6A after being assembled.
Figure 6C:
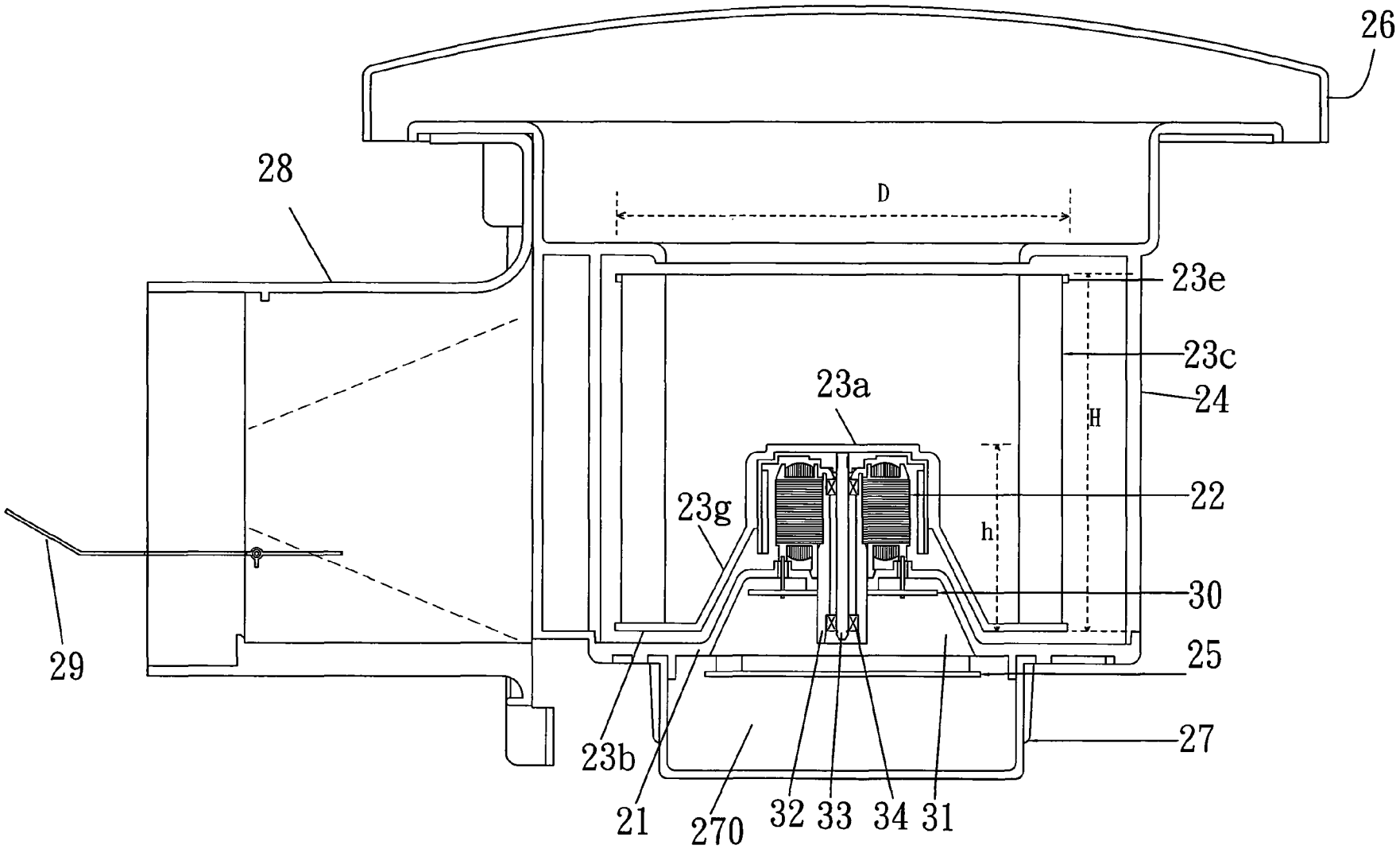
FIG. 6C is a cross-sectional view of the ventilator along the line AA' shown in FIG. 6B.
Figure 7:
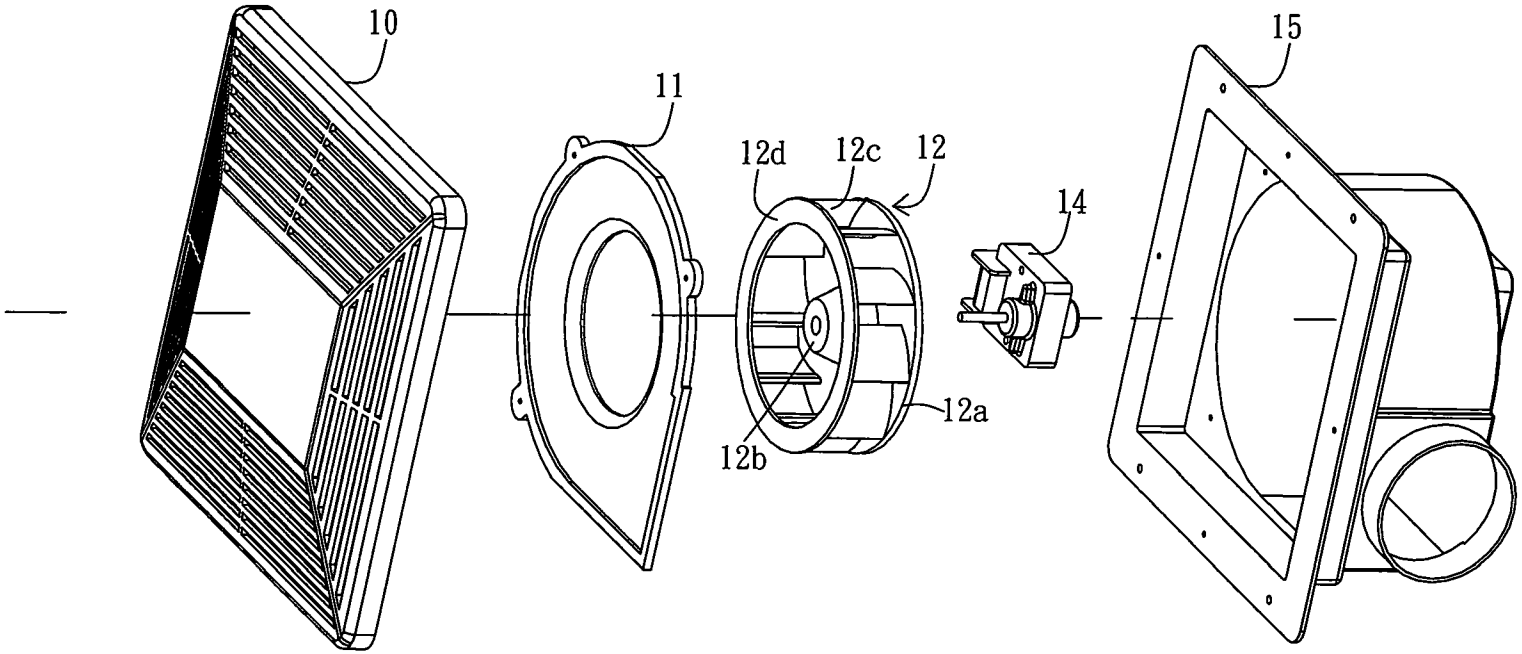
Fig. 7 (Prior Art)
FIG. 7 is an exploded view of the conventional bathroom ventilator.

FIGS. 5A and 5B shows two types of impellers which can be applied to the ventilator of the present invention shown in FIGS. 6A~6C. The impeller 23 shown in FIG. 5A includes a hub 23*a* having a curved or stepped surface at the periphery of the top thereof, a base plate 23*b* coupled to the hub 23*a*, and a first blade set 23*c* disposed around the hub 23*a* and on the base plate 23*b*. There is a first annular part 23*e* disposed at the outer lateral edge of each blade of the first blade set 23*c* for connecting each blade.

The impeller shown in FIG. 5A is exemplified by the first blade set 23*c*, but the impeller 23 shown in FIG. 5B has the first blade set 23*c* and the second blade set 23*d*, both of which are disposed around the hub. The first blade set 23*c* is coupled with the second blade set 23*d* by a second annular part 23*f*. The first blade set 23*c* has a plurality of blades disposed at one side of the second annular part 23*f*, and the second blade set 23*d* also has a plurality of blades disposed at the opposite side of the second annular part 23*f* and alternately or symmetrically arranged with the blades of the first blade set 23*c*. The height of each blade of the second blade set 23*d* can be greater than or equal to that of the first blade set 23*c*.

As shown in FIG. 6C, assuming that the impeller has a diameter D and a height H, the ratio of the height H to the diameter D is preferably greater than 0.6, more preferably ranged between 0.8 and 0.9. The blade number of the impeller is preferably greater than 60, more preferably ranged between 80 and 90, for example, the blade number of the impeller is preferably 86 as shown in FIG. 5A. More preferably, the blade numbers of the first and second blade sets are 83, respectively, as shown in FIG. 5B. The impellers shown in FIGS. 5A and 5B can be used in the ventilator shown in FIG. 6C. The ratio of the height h of the hub 231 to the height H of the impeller is preferably ranged between 0.3 and 0.55.

As shown in FIGS. 6A~6C, the ventilator includes a base 21, a driving device 22 disposed on the base 21, an impeller 23 coupled to the driving device 22 and driven by the driving device 22, a housing 24 assembled with the base 21 for receiving the impeller 23 therein, a first cover 26 assembled with the housing 24, a second cover 27 assembled with the base 21 to define a closed area for receiving a first circuit board 25 therein, and a duct connector 28 assembled with housing 24 by engaging or screwing.

The first cover 26 has a plurality of vents 260 arranged like a rectangular or half-moon profile as shown in FIG. 6A or 6B. There is a baffle 29 pivotally mounted in the duct connector 28. When the driving device 22 drives the impeller 23 to rotate, the generated airflow will make the baffle 29 to be at an open position. When the impeller 23 stops rotate, the baffle 29 will be at the close position due to the gravity.

The base 21 is risen toward the inside of the housing 24 to define an accommodation space 31 as shown in FIG. 6C. The ventilator includes an axial tube 32 with one end passing through the base 21 and extending into the accommodation space 31 for enabling a second circuit board 30 to be telescoped thereon and allowing the second circuit board 30 to be disposed within the accommodation space 31. One or more bearing 34 can be disposed in the axial tube 32, and the driving device 22 is mounted within the hub 23*a* and has a shaft 33 extending into the axial tube 32 to be supported by the bearing 34. The base 21 and the axial tube 32 can be formed together as a single unit by injection molding or can be assembled together after both are individually formed. Additionally, the base plate 23*b* is coupled to the hub 23*a* via an inclined part 23*g* as shown in FIG. 6C. The inclined part 23*g* has an oblique or curve plane for smoothly guiding the airflow toward the blades of the first or second blade set. The inclined part 23*g* correspond to the risen part of the base 21. The hub

23*a*, the inclined part 23*g*, the base plate 23*b*, the blades 23*c*, 23*d* and the first or second annular part 23*e*, 23*f* can be formed together as a single unit by injection molding or can be assembled together after they are individually formed. The base 21 and the housing 24 can also be formed together as a single unit by injection molding or can be assembled together after both are individually formed.

Referring to FIGS. 6A~6C, the driving device 22 can be a brushless DC motor and the first circuit board 25 can be an AC to DC printed circuit board (PCB) including the AC/DC converter 250 as shown in FIGS. 2B and 3. The AC power source $S_{AC}$ is input to the ventilator of the present invention and then converted to the DC power source $S_{DC}$ to drive the brushless DC motor 22 to rotate.

Referring to FIGS. 3 and 6C again, the second circuit board 30 can be a DC drive circuit board including a control module 22*b* electrically connected to the AC/DC converter 250. The second cover 27 and the base 21 are assembled to define an accommodating space as the closed area for receiving the first circuit board 25 therein to prevent the contamination of moisture and dust. Of course, the first circuit board 25 and the second circuit board 30 can be integrated in the same circuit board and received within the closed area between the second cover 27 and the base 21.

The first cover 26 and the housing 24, the duct connector 28 and the housing 24, the base 21 and the housing 24, and the base 21 and the second cover 27 can be assembled by screwing, engaging, locking or adhering, respectively To sum up the above-description, the DC drive circuit board for controlling motor and the AC/DC converter 250 are disposed within the closed area formed between the base and the second cover. Thus, such a simplified water-proof structure can attain the functions of accommodating and protecting the circuit board and meet the requirement of safety specification.

In addition, the impeller of the present invention is designed by high depth ratio and dense of blades to greatly enhance the performance of fan and reduce the noise. In the same noise level, the blades are arranged more densely, the airflow pressure and volume will be higher. In the same airflow volume, the dense blades have lower noise.

Finally, the bathroom ventilator of the present invention drives and controls the rotation speed of the motor according to the soft-start signal so that the rotation speed of the bathroom ventilator can be increased slowly to the target rotation speed. Further, the ventilator of the present invention is input by the AC power source and outputs a DC power source via the conversion by the AC/DC converter. Compared with the prior art, the present invention can reduce the noise and prevent the inrush current, voltage spike or spike noise, thereby increasing the product reliability and extending the life time of the ventilator.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A ventilator comprising:

a base;

a drive device disposed on the base;

an impeller coupled to the drive device and driven by the drive device;

a cover assembled with the base to define a closed area between the cover and the base for receiving a first circuit board therein, wherein when an AC power source is input to the first circuit board to be converted, a DC power source is output to drive the drive device;

a housing for receiving the impeller therein, wherein the base is disposed in the housing, and risen toward an inside of the housing to form an accommodation space;

an axial tube having an end passing through the base and extended into the accommodation space, wherein at least one bearing is disposed in the axial tube; and a second circuit board telescoped onto the end of the axial tube and disposed in the accommodation space, wherein the first circuit board comprises an AC/DC converter, and the AC/DC converter comprises a voltage-drop module for outputting the DC power source to the drive device, and a rectification module coupled to the voltage-drop module for receiving the AC power source.

2. The ventilator according to claim 1, further comprising a duct connector assembled with the housing, and a baffle disposed in the duct connector, wherein the baffle is opened by the airflow generated from the impeller when the impeller is driven and rotated by the drive device, and the baffle is closed by gravity when the impeller stops to rotate.

3. The ventilator according to claim 1, wherein the second circuit board is a DC drive circuit board.

4. The ventilator according to claim 3, wherein the AC/DC converter comprises two diodes to prevent a reverse current.

5. The ventilator according to claim 1, wherein the rectification module comprises an AC filter and a bridge rectification circuit, the AC filter receives the AC power source and filters a low-band frequency portion of the AC power source away, and the bridge rectification circuit is coupled to the AC filter and the voltage-drop module for converting the AC power source into the DC power source to be transmitted to the voltage-drop module.

6. The ventilator according to claim 1, wherein the voltage-drop module comprises:

a transformer coupled to the rectification module for decreasing the DC power source to a work voltage;

a switch electrically connected to the transformer for outputting the stabilized work voltage;

a coupler coupled to the transformer for retrieving a feedback signal from the transformer and outputting a coupling signal;

a controller electrically connected to the switch and the coupler for outputting a control signal to the switch according to the coupling signal; and a DC filter coupled to the transformer and the control device for receiving the stabilized work voltage and filtering a high-band frequency portion of the stabilized work voltage.

7. The ventilator according to claim 6, wherein the first circuit board further Comprises a control module electrically connected to the AC/DC converter and the drive device.

8. The ventilator according to claim 7, wherein the control module comprises a converter, a Hall element and a micro control unit (MCU), the converter is coupled to the DC filter for decreasing the work voltage, the decreased work voltage is used as a power source for the Hall element and the MCU.

9. The ventilator according to claim 8, wherein the MCU is coupled to the drive device for generating a soft-start signal to drive and control a rotation speed of the drive device.

10. The ventilator according to claim 9, wherein the Hall element is coupled to the MCU for sensing a variation of a magnetic field of the drive device so as to output a feedback signal to the MCU, and the MCU controls the drive device according to the feedback signal.

11. The ventilator according to claim 1, wherein the first and second circuit boards are integrated in the same circuit board and disposed in the closed area formed between the base and the cover.

12. The ventilator according to claim 1, wherein the impeller comprises:

a hub;

a base plate coupled to the hub;

a first blade set disposed around the hub and on the base plate; and a first annular part disposed at an outer lateral edge of each blade of the first blade set.

13. The ventilator according to claim 12, wherein the impeller further comprises a second blade set disposed around the hub, the first and second blade sets are coupled with each other by a second annular part, and the first blade set has a plurality of blades arranged with those of the second blade set in an alternate or symmetrical manner.

14. The ventilator according to claim 12, wherein a ratio of a height of the hub to that of the impeller is ranged between 0.3 and 0.55.

15. The ventilator according to claim 12, wherein the base plate is coupled to the hub through an inclined part with an oblique or curved plane.

16. The ventilator according to claim 12, wherein a ratio of a height of the impeller to a diameter of the impeller is ranged between 0.8 and 0.9.

17. The ventilator according to claim 12, wherein a blade number of the impeller is greater than 60.

* * * * *